US010683799B2

(12) United States Patent
Datar et al.

(10) Patent No.: US 10,683,799 B2
(45) Date of Patent: Jun. 16, 2020

(54) FUEL INJECTOR CLEANING SYSTEM, FLUID, AND METHOD

(71) Applicant: CUMMINS INC., Columbus, IN (US)

(72) Inventors: Yogesh Gajanan Datar, Columbus, IN (US); Aswin Kumar Muthukumar, Columbus, IN (US); Michael Andrew Lucas, Columbus, IN (US)

(73) Assignee: Cummins Inc., Columbus, IN (US)

( * ) Notice: Subject to any disclaimer, the term of this patent is extended or adjusted under 35 U.S.C. 154(b) by 102 days.

(21) Appl. No.: 15/958,118

(22) Filed: Apr. 20, 2018

(65) Prior Publication Data

US 2018/0313265 A1 Nov. 1, 2018

(30) Foreign Application Priority Data

Apr. 27, 2017 (CN) ..... 2017 1 02871871
Apr. 27, 2017 (CN) ..... 2017 2 04551375 U

(51) Int. Cl.
*C11D 7/08* (2006.01)
*F02B 77/04* (2006.01)
(Continued)

(52) U.S. Cl.
CPC ..... *F02B 77/04* (2013.01); *C11D 7/08* (2013.01); *C11D 7/261* (2013.01);
(Continued)

(58) Field of Classification Search
CPC ..... C11D 11/0041; C11D 3/042; C11D 7/261
(Continued)

(56) References Cited

U.S. PATENT DOCUMENTS 5,264,146 A * 11/1993 Tobiason ..... C11D 3/0052 134/7
5,871,590 A 2/1999 Hei et al.
(Continued)

FOREIGN PATENT DOCUMENTS

CN 1798919 7/2006
CN 1919982 2/2007
(Continued)

OTHER PUBLICATIONS

Appeal Brief for U.S. Appl. No. 10/494,267, decided on Aug. 17, 2009, pp. 1-12.
(Continued)

*Primary Examiner* — Gregory E Webb
(74) *Attorney, Agent, or Firm* — Foley & Lardner LLP

(57) ABSTRACT

A fuel injector cleaning system includes an injector cleaning housing that defines a cavity structured to receive a fuel injector. A heater is operatively coupled to the housing. A three-way valve includes a first inlet fluidly coupled to a calibration fluid reservoir, and a second inlet fluidly coupled to a cleaning fluid reservoir. An intake line includes a first end fluidly coupled to an outlet of the valve, and a second end structured to be fluidly coupled to a fuel inlet of the fuel injector. A controller is operatively coupled to each of the heater and the valve. The controller is structured to actuate the valve so as to cause flow of a cleaning fluid to the fuel injector. The heater is operated so as to heat the cleaning fluid. The valve is actuated so as to cause flow of a calibration fluid to the fuel injector.

6 Claims, 3 Drawing Sheets

(51) Int. Cl.

| | |
|---|---|
| ***F02M 65/00*** | (2006.01) |
| ***C11D 11/00*** | (2006.01) |
| ***C11D 7/26*** | (2006.01) |
| *C11D 3/04* | (2006.01) |
| *C11D 3/43* | (2006.01) |

(52) U.S. Cl.
CPC ..... *C11D 11/0041* (2013.01); *F02M 65/008* (2013.01); *C11D 3/042* (2013.01); *C11D 3/43* (2013.01)

(58) Field of Classification Search
USPC ..... 510/184
See application file for complete search history.

(56) References Cited

U.S. PATENT DOCUMENTS

| | | | | |
|---|---|---|---|---|
| 8,486,882 | B2 | 7/2013 | Bayless et al. | |
| 2004/0026535 | A1* | 2/2004 | Conway | B65D 81/3288 239/433 |
| 2005/0054552 | A1 | 3/2005 | Sakurai et al. | |
| 2012/0088711 | A1* | 4/2012 | Bayless | C23F 3/00 510/258 |
| 2012/0208733 | A1* | 8/2012 | Quarles | B05B 11/3084 510/100 |
| 2012/0258904 | A1* | 10/2012 | Bjelopavlic | C11D 3/1233 510/397 |
| 2014/0296113 | A1 | 10/2014 | Reyes et al. | |
| 2017/0009183 | A1* | 1/2017 | Schwerter | C11D 1/72 |
| 2018/0142189 | A1* | 5/2018 | Gerard | C11D 3/43 |
| 2018/0362887 | A1* | 12/2018 | Motsenbocker | C11D 3/2086 |

FOREIGN PATENT DOCUMENTS

| | | |
|---|---|---|
| CN | 106471109 | 3/2017 |
| CN | 207130233 | 3/2018 |
| RU | 2550416 | 4/2014 |
| WO | WO-2010/150120 | 12/2010 |
| WO | WO-2014/160643 | 10/2014 |

OTHER PUBLICATIONS

CN Office Action for CN Application No. 201710287187.1, dated Mar. 16, 2020.

* cited by examiner

FUEL INJECTOR CLEANING SYSTEM, FLUID, AND METHOD

CROSS-REFERENCE TO RELATED APPLICATIONS

This application claims priority to and the benefit of Chinese Utility Model Application No. 2017204551375, filed on Apr. 27, 2017 and Chinese Patent Application No. 2017102871871, filed on Apr. 27, 2017, the contents of which are fully incorporated by reference herein in their entirety.

TECHNICAL FIELD

The present disclosure relates generally to the field of fuel injector cleaning systems and fluids.

BACKGROUND

Internal combustion engines include fuel injectors that are structured to inject fuel into combustion chambers of the engine. Properly functioning fuel injectors inject the fuel in an optimal atomized-mist that burns cleanly to optimize engine performance and minimize emissions. However, deposits can build up on fuel injectors over time from impurities in the fuel. Such deposits can hinder operation of the precisely-controlled fuel injectors, thereby reducing engine performance, such as through reduced output power, increased frequency of hard starts, reduced fuel economy, and increased emissions.

SUMMARY

Various embodiments relate to a fuel injector cleaning fluid. An example fuel injector cleaning fluid is a mixture consisting of approximately 78 percent water, 20 percent ethanol, and 2 percent Sulfamic acid.

Various other embodiments relate to a fuel injector cleaning system. In one example embodiment, a fuel injector cleaning system includes an injector cleaning housing that defines a cavity structured to receive a fuel injector. A heater is operatively coupled to the injector cleaning housing so as to controllably heat the injector cleaning housing. A three-way valve is structured to controllably permit fluid flow to an outlet from at least one of a first inlet and a second inlet. The first inlet is fluidly coupled to a calibration fluid reservoir, and the second inlet is fluidly coupled to a cleaning fluid reservoir. An intake line includes a first end and a second end. The first end is fluidly coupled to the outlet of the three-way valve, and the second end is structured to be fluidly coupled to a fuel inlet of the fuel injector. A controller is operatively coupled to each of the heater and the three-way valve. The controller is structured to actuate the three-way valve so as to cause flow of a cleaning fluid from the cleaning fluid reservoir to the fuel injector. The heater is operated so as to heat the cleaning fluid in the injector cleaning housing. The three-way valve is actuated so as to cause flow of a calibration fluid from the calibration fluid reservoir to the fuel injector.

Various other embodiments relate to a method of cleaning a fuel injector. In an example method, a sulfamic acid-based cleaning fluid is applied to a fuel injector. The cleaning fluid is pressurized to a predetermined pressure. The cleaning fluid is heated to a predetermined temperature. The fuel injector is flushed with a calibration fluid.

Various other embodiments relate to a fuel injector cleaning fluid. An example fuel injector cleaning fluid is a mixture comprising water, ethanol, and sulfamic acid, with water in a range of 78 percent to 82 percent by weight, ethanol in a range of 14 percent to 18 percent by weight, and sulfamic acid in a range of 1 percent to three percent by weight.

These and other features, together with the organization and manner of operation thereof, will become apparent from the following detailed description when taken in conjunction with the accompanying drawings, wherein like elements have like numerals throughout the several drawings described below.

BRIEF DESCRIPTION OF THE DRAWINGS

The details of one or more implementations are set forth in the accompanying drawings and the description below. Other features, aspects, and advantages of the disclosure will become apparent from the description, the drawings, and the claims.

Figure 1:
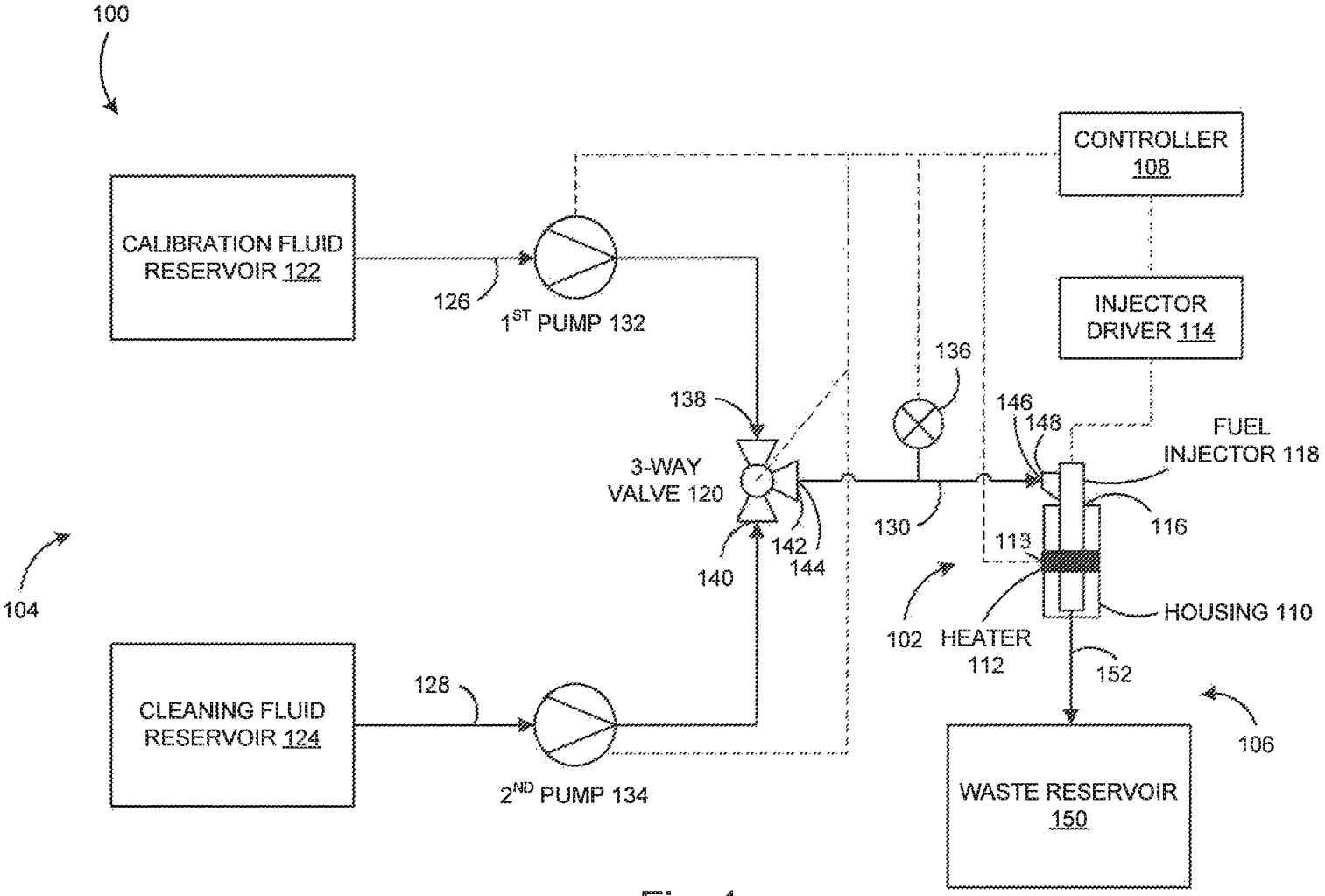
FIG. 1 is a schematic diagram of a fuel injector cleaning system, according to an example embodiment.

It will be recognized that some or all of the figures are schematic representations for purposes of illustration. The figures are provided for the purpose of illustrating one or more implementations with the explicit understanding that they will not be used to limit the scope or the meaning of the claims.

DETAILED DESCRIPTION

The fuel injectors are susceptible to fouling from contaminating deposits, such as sulfates originating from particulate matter, atmospheric pollution, particulates and water present in fuel. The frequency and severity of fuel injector fouling is dependent at least in part on the quality of fuel used with the fuel injectors. Fuel contaminate standards vary country-by-country. To that end, fuel injector fouling is more problematic in some countries than it is in others.

Various cleaning fluids (also referred to as cleaning solutions) and cleaning systems for cleaning fuel injectors are currently available. For example, some existing cleaning fluids utilize hydrochloric acid, phosphoric acid, carboxylic acid, and other types of acids. Although such cleaning fluids may remove particulate deposits, they may cause corrosion on fuel injectors. Such cleaning fluids may also be dangerous to handle. Accordingly, in some cases, these cleaning fluids can be used only by certified technicians with specialized equipment. Therefore, some fuel injector cleaning fluids are not suitable for use in some service garages.

Various embodiments relate to a Sulfamic acid-based cleaning fluid. For example, in some embodiments, the cleaning fluid is an aqueous solution of Sulfamic acid and ethanol. In some embodiments, the Sulfamic acid-based cleaning fluid comprises a mixture consisting of approximately 78 percent water, 20 percent ethanol, and 2 percent Sulfamic acid. In some embodiments, the sulfamic acid-based cleaning fluid comprises a mixture consisting of water, ethanol, and 2 percent sulfamic acid. In some embodiments, the sulfamic acid based cleaning fluid comprises a mixture consisting of water, ethanol, and 2 percent sulfamic acid. In some embodiments, the sulfamic acid-based cleaning fluid comprises ethanol, sulfamic acid, and 80 percent water. In some embodiments, the sulfamic acid-based cleaning fluid comprises a range of 78-82 percent water, 1-3 percent sulfamic acid, and 14-18 percent ethanol (all ranges being inclusive). In a particular implementation, the sulfamic acid is 2.05 percent of the mixture, the water is 81.80 percent of the mixture, and wherein the ethanol is 16.15 percent of the mixture. As used herein, the mixture of the constituent components of the Sulfamic acid-based cleaning fluid is determined by volume, while in other embodiments, it is determined by weight. In various embodiments, the Sulfamic acid-based cleaning fluid does not include any acid except for Sulfamic acid. For example, the Sulfamic acid-based cleaning fluid does not include any of hydrochloric acid, phosphoric acid, and carboxylic acid. It should be understood that, although the percentages of the constituent components of the sulfamic acid-based cleaning fluid are described herein as being specific values, each percentage is intended to include a range comprising the stated percentage±1 percent of the total mixture.

The instant Sulfamic acid-based cleaning fluid provides various technical advantages over existing fuel injector cleaning fluids. For example, the particular composition of the Sulfamic acid-based cleaning fluid, including particular proportions of water, ethanol, and Sulfamic acid, provides superior performance in cleaning deposits (e.g., sulfate-based and calcium-based deposits) from fuel injectors when used in combination with both heat and pressure compared to existing cleaning fluids. In some embodiments, the Sulfamic acid-based cleaning fluid is structured to be utilized at a temperature of approximately 200 degrees F. and a pressure of approximately 1000 psi to clean fuel injectors. In some embodiments, the Sulfamic acid-based cleaning fluid is structured to be utilized above 200 degrees F. and above 1000 psi to clean fuel injectors.

The Sulfamic acid-based cleaning fluid is also more environmentally friendly and more widely available for use than existing fuel injector cleaning fluids. Some existing fuel injector cleaning fluids include a higher concentration of acid than the instant Sulfamic acid-based cleaning fluid. In addition, some existing fuel injector cleaning fluids include certain acids or other chemicals that are more dangerous to humans or to the environment than the Sulfamic acid-based cleaning fluid. Therefore, the Sulfamic acid-based cleaning fluid can be utilized in many different types of service garages rather than only those with certified technicians and/or specialized equipment. Further, used Sulfamic acid-based cleaning fluid can be discarded without specialized treatment, whereas other cleaning fluids must be stored and/or treated in a specific manner. Further still, because the Sulfamic acid-based cleaning fluid is water-based and water is denser than fuel, the Sulfamic acid-based cleaning fluid sinks to the bottom of a fuel injector during a cleaning process to displace any residual fuel out of the fuel injector, thereby facilitating thorough cleaning.

Various other embodiments relate to a fuel injector cleaning system structured to clean fuel injectors using a Sulfamic acid-based cleaning fluid. According to various embodiments, the fuel injector cleaning system is structured to apply a Sulfamic acid-based cleaning fluid to a fuel injector at a particular temperature and pressure (e.g., approximately 200 degrees F. and 1000 psi) in order to remove sulfate-based and other deposits from the fuel injector. In some embodiments, the fuel injector cleaning system applies Sulfamic acid-based cleaning fluid to the fuel injector during a first stage of a cleaning cycle, and subsequently flushes the fuel injector with a calibration fluid during a second stage of the cleaning cycle. Flushing the fuel injector with the calibration fluid helps to prevent corrosion on the fuel injector.

The fuel injector cleaning system described herein provides various technical advantages over existing fuel injector cleaning systems. For example, the instant fuel injector cleaning system is structured to apply a Sulfamic acid-based cleaning fluid to a fuel injector at a particular temperature and pressure, which has been found to produce superior cleaning results compared to existing systems. In addition, the instant fuel injector cleaning system utilizes relatively inexpensive and readily available components, thereby requiring much less capital investment than existing industrial fuel injector cleaning systems. Further, the instant fuel injector cleaning system cleans injectors without requiring disassembly thereof. Accordingly, such technical advantages allow wide adoption of the instant fuel injector cleaning system in plants and garages in order to restore fouled injectors to proper operation instead of simply scrapping the fouled injectors.

FIG. 1 is a schematic diagram of a fuel injector cleaning system 100, according to an example embodiment. The fuel injector cleaning system 100 is structured to remove particulate matter deposits from fuel injectors. According to various embodiments, the fuel injector cleaning system 100 is structured to utilize a Sulfamic acid-based cleaning fluid. More specifically, in some embodiments, the fuel injector cleaning system 100 is structured to utilize the Sulfamic acid-based cleaning fluid described herein, comprising a mixture of approximately 78 percent water, 20 percent ethanol, and 2 percent Sulfamic acid. The fuel injector cleaning system 100 is structured to utilize both heat and pressure in connection with the Sulfamic acid-based cleaning fluid in order to provide superior cleaning results compared to existing cleaning systems and fluids.

According to various embodiments, the fuel injector cleaning system 100 includes an injector cleaner assembly 102, a fluid delivery assembly 104, a waste assembly 106, and a controller 108.

The injector cleaner assembly 102 comprises an injector cleaning housing 110, a heater 112, a temperature sensor 113, and an injector driver 114. The injector cleaning housing 110 defines a cavity 116 structured to receive a fuel injector 118. In some embodiments, the cavity 116 is structured similarly to that of a cylinder head to which the fuel injector 118 is intended to be attached for operation. In some embodiments, the fuel injector 118 is a diesel fuel injector. However in other embodiments, the fuel injector 118 is structured to inject any of various types of fuel, such as natural gas, propane, ethanol, gasoline, etc.

In some embodiments, the fuel injector cleaning system 100 includes multiple injector cleaner assemblies 102. In such embodiments, the fuel injector cleaning system 100 is capable of cleaning multiple fuel injectors 118 simultaneously.

The heater 112 is operatively coupled to the injector cleaning housing 110 so as to controllably heat the injector cleaning housing 110, thereby heating fluid therein, including fluid in and around the fuel injector 118. The heater is positioned on the injector cleaning housing so as to be proximate a nozzle of the fuel injector 118 to be positioned in the injector cleaning housing 110.

The temperature sensor 113 is operatively coupled to the injector cleaning housing 110 and is operatively and communicatively coupled to the controller 108. The temperature sensor 113 is structured to measure a temperature indicative of a temperature of fluid in the injector cleaning housing 110, and to transmit a signal indicative of the measured temperature value to the controller 108. In some embodiments, the temperature sensor 113 is a thermocouple. In other embodiments, the temperature sensor 113 is a thermistor or another type of temperature sensor. In some embodiments, the temperature sensor 113 extends through the injector cleaning housing 110 and directly measures a fluid temperature. However, in other embodiments, the temperature sensor 113 is structured to measure a temperature of the injector cleaning housing 110. In such implementations, a temperature of fluid in the injector cleaning housing 110 is inferred based on the temperature of the injector cleaning housing 110.

The injector driver 114 is structured to be operatively coupled to the fuel injector 118. The injector driver 114 is controllably actuates the fuel injector 118 during a cleaning process. More specifically, the injector driver 114 sends electrical control signals to the fuel injector 118 to actuate a solenoid of the fuel injector 118, thereby causing movement of a valve plunger of the fuel injector 118. In operation on an engine, this causes a precisely controlled amount of fuel to be dispensed from a nozzle of the fuel injector 118. In some embodiments, the injector driver 114 utilized with the fuel injector cleaning system 100 is a benchtop version specifically designed to bench test fuel injectors 118. In other embodiments, the injector driver 114 is integrated in an electronic control module ("ECM"), which may be included in, or separate from, the controller 108.

The fluid delivery assembly 104 comprises a three-way valve 120, a calibration fluid reservoir 122, a cleaning fluid reservoir 124, a first supply line 126, a second supply line 128, an intake line 130, a first pump 132, a second pump 134, and a pressure sensor 136.

The three-way valve 120 is structured to controllably permit flow of at least one of a cleaning fluid and a calibration fluid to the fuel injector 118. The three-way valve 120 includes a first inlet 138, a second inlet 140, and an outlet 142. The first supply line 126 fluidly couples the calibration fluid reservoir 122 and the first inlet 138 of the three-way valve 120 so as to provide fluid flow of calibration fluid therebetween. The second supply line 128 fluidly couples the cleaning fluid reservoir 124 and the second inlet 140 of the three-way valve 120 so as to provide fluid flow of cleaning fluid therebetween. The intake line 130 extends between a first end 144 and a second end 146. The first end 144 is fluidly coupled to the outlet 142 of the three-way valve 120. In some embodiments, the second end 146 is structured to be fluidly coupled to a fuel inlet 148 of the fuel injector 118 in the injector cleaning housing 110. Accordingly, in operation, the intake line 130 fluidly couples the outlet 142 of the three-way valve 120 and the fuel inlet 148 of the fuel injector 118 so as to provide fluid flow of the at least one of calibration fluid and cleaning fluid flowing therebetween. In other embodiments, the second end 146 is structured to be fluidly coupled to the injector cleaning housing 110. Accordingly, in operation, the intake line 130 fluidly couples the outlet 142 of the three-way valve 120 and the injector cleaning housing 110 so as to provide fluid flow of the at least one of calibration fluid and cleaning fluid flowing therebetween. In some embodiments, each of the first and second supply lines 126, 128 and the intake line 130 is formed of stainless steel tubing. In other embodiments, at least one of the first and second supply lines 126, 128 and the intake line 130 is formed of other types of metal or polymer tubing.

The three-way valve 120 is controllable between a first position, a second position, and intermediate positions therebetween. When the three-way valve 120 is in the first position, the three-way valve 120 permits calibration fluid to flow from the calibration fluid reservoir 122 to the fuel inlet 148 of the fuel injector 118. When the three-way valve 120 is in the second position, the three-way valve 120 permits cleaning fluid to flow from the cleaning fluid reservoir 124 to the fuel inlet 148 of the fuel injector 118. Intermediate positions of the three-way valve 120 permit a corresponding relative amount of each of the calibration fluid and the cleaning fluid to be transmitted to the fuel inlet 148 of the fuel injector 118.

As described in further detail below, in some embodiments, the three-way valve 120 is an electronically-controlled valve such that the valve position is controlled in response to a control signal received from the controller 108. In other embodiments, the three-way valve 120 is mechanically-controlled such that the valve position is changed by a human operator. In other embodiments, the three-way valve 120 permits flow of each of calibration fluid and cleaning fluid therethrough, and flow of each fluid is controlled via operation of each of the first and second pumps 132, 134.

The first pump 132 is operatively coupled to the first supply line 126 so as to pressurize calibration fluid flowing through the first supply line 126. The first pump 132 can be any of various types of pumps. For example, in some embodiments, the first pump 132 is a motor-driven commercial pump. In some embodiments, the first pump 132 is a hydraulic hand pump. In some embodiments, the first pump 132 is a pneumatic hydraulic pressure pump. In operation, according to various embodiments, the first pump 132 is structured to pressurize the calibration fluid in the first supply line 126 to about 3000 psi. In some embodiments, the first pump 132 is structured to pressurize the calibration fluid in the first supply line 126 to at least 2000 psi. Other embodiments utilize other types of fluid instead of calibration fluid. For example, according to various embodiments, instead of calibration fluid, the fuel injector cleaning system 100 utilizes any fluid having anti-corrosive properties.

The second pump 134 is operatively coupled to the second supply line 128 so as to pressurize cleaning fluid flowing through the second supply line 128. The second pump 134 can be any of various types of pumps. For example, in some embodiments, the second pump 134 is a motor-driven commercial pump. In some embodiments, the second pump 134 is a reciprocating fluid pump. In one embodiment, the second pump 134 is an electric pressure washer. For example, in one embodiment, the second pump 134 is an electric pressure washer structured to pressurize a fluid at up to 1650 psi at a flow rate of up to 1.25 gallons per minute. In other embodiments, the second pump 134 is a different type of fluid pump.

The pressure sensor 136 is operatively coupled to the intake line 130 so as to measure a pressure of fluid (e.g., at least one of calibration fluid and cleaning fluid) flowing therethrough. In some embodiments, the pressure sensor 136 includes an analog pressure gauge. In other embodiments, the pressure sensor 136 is structured to transmit an electronic signal (e.g., to the controller 108) indicative of a measured pressure. Although not illustrated in FIG. 1, it should be understood that, in various embodiments, the fuel injector cleaning system 100 includes various other sensors, such as pressure sensors, temperature sensors, etc. For example, in some embodiments, the injector cleaner system includes a second pressure sensor operatively coupled to the first supply line 126 and a third pressure sensor operatively coupled to the second supply line 128 to respectively measure pressures of fluids flowing therethrough.

The waste assembly 106 includes a waste reservoir 150 fluidly coupled to the injector cleaning housing 110 via a waste line 152. The waste line 152 provides fluid communication of calibration fluid and cleaning fluid from the injector cleaning housing 110 to the waste reservoir 150. The cleaning fluid is transmitted to the waste reservoir 150 after being applied to the fuel injector 118 during a cleaning process. Similarly, the calibration fluid is transmitted to the waste reservoir 150 after flushing the fuel injector 118 subsequent the cleaning fluid being applied to the fuel injector 118. Therefore, the cleaning fluid and the calibration fluid transmitted to the waste reservoir 150 may include particulate matter removed from the fuel injector 118. In some embodiments, the waste assembly includes two waste reservoirs 150, one for each of the cleaning fluid and the calibration fluid. In such embodiments, at least one of the cleaning fluid and calibration fluids may be collected from the respective waste reservoir 150, filtered, and reused.

The controller 108 is operatively and communicatively coupled to at least one of the heater 112, the temperature sensor 113, the injector driver 114, the fuel injector 118, the three-way valve 120, the first and second pumps 132, 134; and the pressure sensor 136. In some embodiments, the controller 108 is also operatively and communicatively coupled to other sensors and components not illustrated in FIG. 1. As described further below in connection with FIG. 2, the controller 108 is structured to control operation of the fuel injector cleaning system 100 through various cleaning cycles. More specifically, the controller 108 is structured to operate the heater 112 and the three-way valve 120, and to actuate the fuel injector 118 via the injector driver 114, in accordance with cleaning process parameters. In some embodiments, the controller 108 is structured to determine various operating conditions of the injector cleaning system (e.g., temperatures, pressures, etc.), and to control operation of the fuel injector cleaning system 100 based on the determined conditions.

For example, in one embodiment, a cleaning cycle includes a first stage and as second stage. In the first stage, the controller 108 is structured to actuate the three-way valve 120 so as to cause flow of cleaning fluid from the cleaning fluid reservoir 124 to the fuel injector 118. The controller 108 is also structured to operate the heater 112 so as to heat the cleaning fluid flowing through the fuel injector 118. In the second stage, following the first stage, the controller 108 is structured to actuate the three-way valve 120 so as to cause flow of calibration fluid from the calibration fluid reservoir 122 to the fuel injector 118. An example injector cleaning process is described further in connection with FIG. 3.

Figure 2:
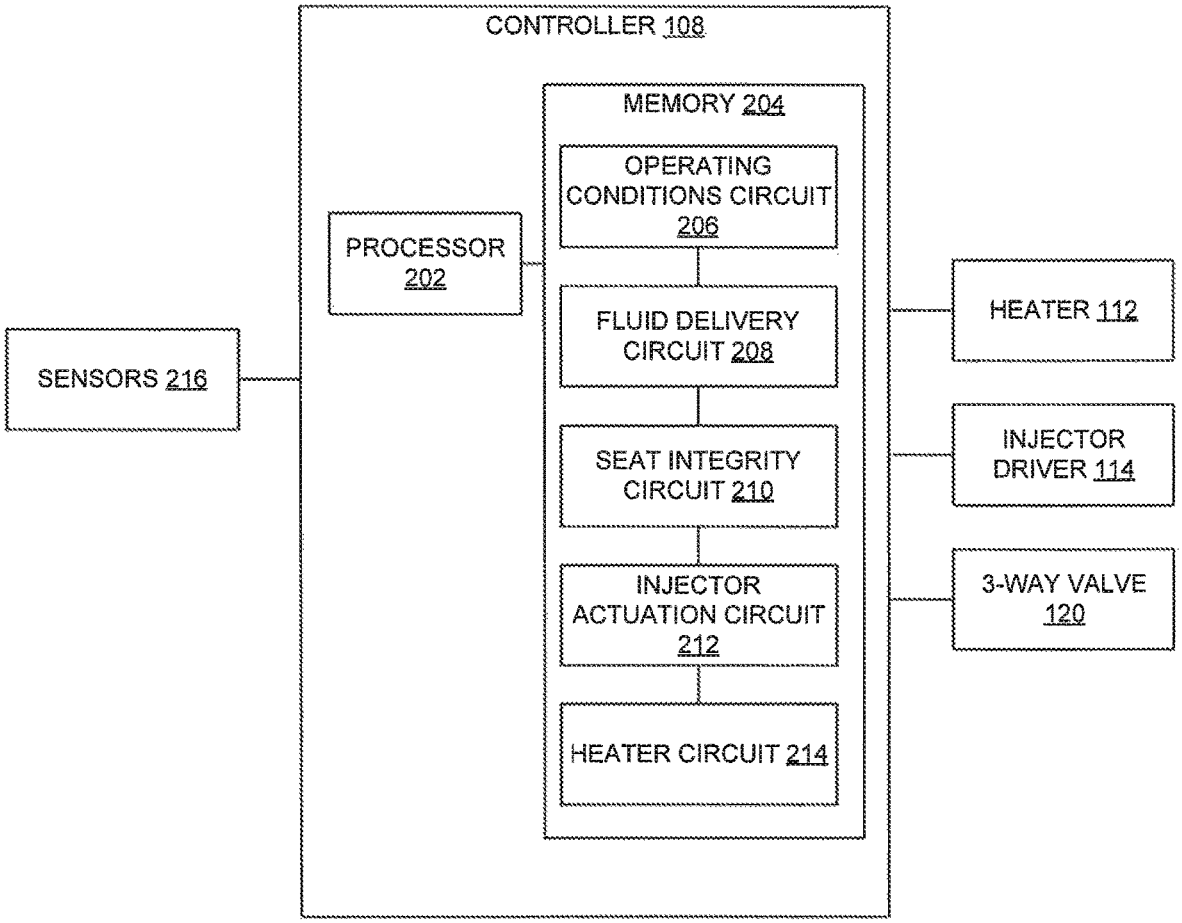
FIG. 2 is a block diagram of a controller of the fuel injector cleaning system of FIG. 1.

FIG. 2 is a block diagram of the controller 108 of the fuel injector cleaning system 100 of FIG. 1. The controller 108 includes a processor 202 and memory 204. The memory 204 is shown to include an operating conditions circuit 206, a fluid delivery circuit 208, a seat integrity circuit 210, an injector actuation circuit 212, and a heater circuit 214 communicably coupled to each other. In general, the controller 108 is structured to control operation of at least one of the heater 112, the injector driver 114, and the three-way valve 120 to conduct an injector cleaning cycle. While various circuits with particular functionality are shown in FIG. 2, it should be understood that the controller 108 may include any number of circuits for completing the functions described herein. For example, the activities of multiple circuits may be combined as a single circuit, additional circuits with additional functionality may be included, etc. Further, it should be understood that the controller 108 may further control other cleaning system and/or engine activity beyond the scope of the present disclosure.

Certain operations of the controller 108 described herein include operations to interpret and/or to determine one or more parameters. Interpreting or determining, as utilized herein, includes receiving values by any method known in the art, including at least receiving values from a datalink or network communication, receiving an electronic signal (e.g. a voltage, frequency, current, or PWM signal) indicative of the value, receiving a computer generated parameter indicative of the value, reading the value from a memory location on a non-transient computer readable storage medium, receiving the value as a run-time parameter by any means known in the art, receiving a value by which the interpreted parameter can be calculated, and/or by referencing a default value that is interpreted to be the parameter value.

The operating conditions circuit 206 is in operative communication with various sensors 216. For example, the sensors 216 may include the temperature sensor 113, the pressure sensor 136, other temperatures and pressure sensors, and other types of sensors. The operating conditions circuit 206 is structured to receive measurement values from the sensors 216 and to interpret measurement values based on the received measurement values. Accordingly, the measurement values may include, but are not limited to, temperature values, pressure values, or other types of system measurement values.

The fluid delivery circuit 208 is structured to control operation of the three-way valve 120 to control flow of at least one of calibration fluid and cleaning fluid to the fuel injector 118. For example, in one embodiment, the fluid delivery circuit 208 is structured to, during a first stage of a cleaning cycle, transmit a first control signal to the three-way valve 120 to cause the three-way valve 120 to move to a second position, thereby causing cleaning fluid to flow from the cleaning fluid reservoir 124 to the fuel inlet 148 of the fuel injector 118. After completion of the first stage, the fluid delivery circuit 208 is structured to, during a second stage of the cleaning cycle, transmit a second control signal to the three-way valve 120 to cause the three-way valve 120 to move to a first position to cause calibration fluid to flow from the calibration fluid reservoir 122 to the fuel inlet 148 of the fuel injector 118. In some embodiments, the fluid delivery circuit 208 is also structured to control operation of at least one of the first and second pumps 132, 134.

The seat integrity circuit 210 is structured to test integrity of a seat of the fuel injector 118 during the first phase of the cleaning cycle or in a pre-cleaning phase. The purpose of the seat is to seal the fuel injector 118 against the cylinder head of the engine. Damage to the seat (loss of integrity of the seat) can result in leakage of pressurized air and fluid between the fuel injector 118 and the cylinder head. The seat integrity circuit 210 is structured to test seat integrity by pressurizing the fuel injector 118 and monitoring pressure loss over a period of time to detect the presence of a leak. In some embodiments, the fuel injector 118 is pressurized by actuating a plunger of the fuel injector 118 to a closed position, actuating the three-way valve 120 to the second position to allow cleaning fluid to flow to the fuel injector 118, and operating the second pump 134 to pressurize the cleaning fluid to a predetermined test pressure. In some embodiments, the second pump 134 is stopped and/or the three-way valve 120 is actuated to a closed position, and pressure in the intake line 130 is measured over time via the pressure sensor 136. Pressure loss over time may be indicative of poor seat integrity. In some instances, the seat may be cleaned to remove particulate deposits, and seat integrity may be retested. However, in other embodiments, the seat may be permanently damaged.

The injector actuation circuit 212 is structured to actuate the fuel injector 118 during a cleaning cycle. In some embodiments, the injector actuation circuit 212 is structured to transmit control signals to the injector driver 114, which controls actuation of the fuel injector 118 based on the received control signals. More specifically, the injector driver 114 varies an electrical current provided to the fuel injector 118, which triggers the solenoid in the fuel injector 118, thereby moving the valve plunger. Actuating the fuel injector 118 during the cleaning process removes more particulate deposits from the fuel injector 118 in a shorter period of time compared to applying the cleaning fluid through the fuel injector 118 with the valve plunger at a single static position.

The heater circuit 214 is structured to operate the heater 112 so as to heat the injector cleaning housing 110, thereby heating fuel flowing through the fuel injector 118. In some embodiments, the heater circuit 214 monitors a temperature of the temperature sensor 113 via a temperature value received from the operating conditions circuit 206, and provides a voltage to the heater 112 so as to maintain the heater 112 at a predetermined temperature throughout at least part of the cleaning process. For example, in some embodiments, the heater circuit 214 is structured to maintain the heater 112 at 120 degrees F. during the first stage of the cleaning process. In some embodiments, the heater circuit 214 is structured to maintain the heater 112 at a particular temperature over multiple cleaning cycles. However, in other embodiments, the heater circuit 214 is structured to maintain the heater at a particular temperature only during a portion (e.g., the first stage) of a cleaning process.

Figure 3:
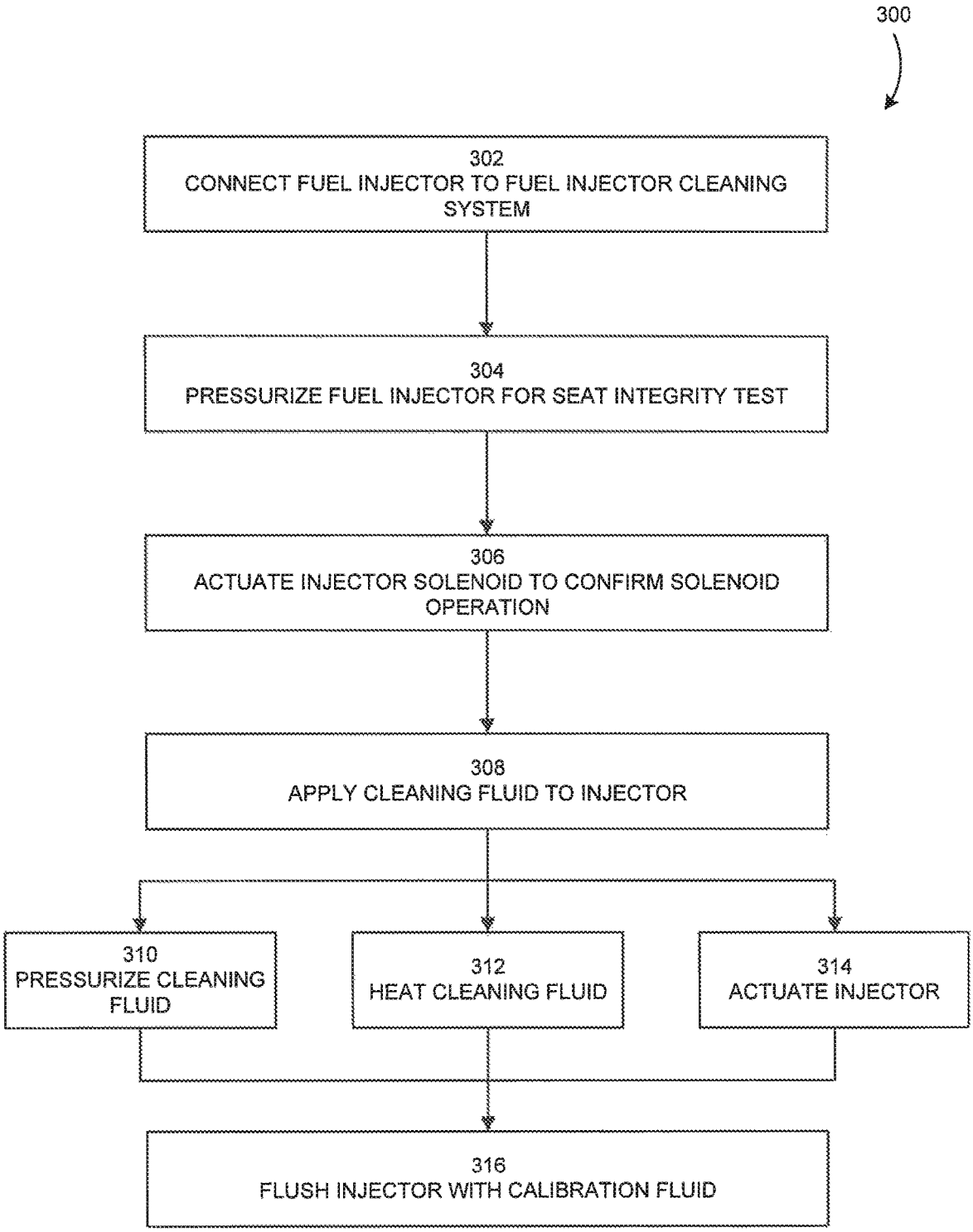
FIG. 3 is a flow diagram illustrating a method of cleaning a fuel injector, according to an example embodiment.

FIG. 3 is a flow diagram illustrating a method 300 of cleaning a fuel injector, according to an example embodiment. In some embodiments, the method 300 is performed by the fuel injector cleaning system 100 of FIG. 1 using a Sulfamic acid-based fuel injector cleaning fluid. However, in other embodiments, the method 300 is similarly performed using other systems and devices.

At 302, a fuel injector (e.g., the fuel injector 118) is connected to the fuel injector cleaning system 100. In some embodiments, the fuel injector 118 is connected to the fuel injector cleaning system 100 by inserting the fuel injector 118 into the injector cleaning housing 110 and connecting the injector driver 114 to the fuel injector 118. In some embodiments, the intake line 130 is connected to the fuel inlet 148 of the fuel injector 118 and the waste line 152 is connected to a fuel return of the fuel injector 118. In other embodiments, at least one of the intake line 130 and the waste line 152 is fluidly coupled to the injector cleaning housing 110 rather than directly to the fuel injector 118.

At 304, the fuel injector 118 is pressurized to test the integrity of its seat. As described above in connection with FIG. 2, seat integrity is tested by pressurizing the fuel injector 118 and monitoring pressure loss over a period of time to detect the presence of a leak. If the pressure loss is greater than a leak threshold amount, the seat is potentially damaged. In this case, the cleaning process is ended and the fuel injector 118 is removed to determine whether the seat can be cleaned or repaired.

At 306, the solenoid of the fuel injector 118 is actuated by the injector driver 114 to confirm that it is operating properly. The solenoid is operating properly if the injector plunger moves as expected in response to control signals received from the injector driver 114. If it is determined that the solenoid is not operating properly, the solenoid is potentially damaged. In some situations, however, detected improper solenoid operation may indicate extreme particulate buildup. For example, a nozzle needle may be stuck in the nozzle of the fuel injector 118. According to various embodiments, the cleaning process may either be continued or ended if the solenoid is found to be operating improperly. For example, in some embodiments, the cleaning process is continued while continuing to attempt to actuate the solenoid to attempt to allow the cleaning fluid to remove enough particulate buildup to permit proper operation of the fuel injector 118.

At 308, cleaning fluid is applied to the fuel injector 118. As described above in connection with FIG. 2, cleaning fluid is cycled through the fuel injector 118 by controlling the three-way valve 120 to the second position. In some embodiments, cleaning fluid is applied to the fuel injector 118 at 304 to perform the seat integrity test. In this case, the cleaning fluid is continued to be applied to the fuel injector at 308. It should be understood that in some embodiments, 304 and 306 are omitted such that the injector is cleaned without evaluating seat integrity and solenoid operation.

At 310, the cleaning fluid is pressurized. In some embodiments, the cleaning fluid is pressurized by operating the second pump 134. In some embodiments, the cleaning fluid is pressurized to 1000 psi. However, in other embodiments, the cleaning fluid is pressurized up to 1650 psi.

At 312, the cleaning fluid is heated. The cleaning fluid is heated by operating the heater 112. In some embodiments, the cleaning fluid is heated to 200 degrees F.

At 314, the fuel injector 118 is actuated. In some embodiments, the fuel injector 118 is continuously actuated so as to cause the solenoid to repeatedly open and close the nozzle.

Although 310-314 are shown in parallel in FIG. 3, in some embodiments, any of 310-314 may be performed in series, in any order. For example, in some embodiments, 310 and/or 312 are performed to pressurize and/or heat the cleaning fluid for a predetermined amount of time before continuing to 314 to actuate the fuel injector 118. For example the cleaning fluid is applied to the fuel injector 118 and heated and/or pressurized for a first time period to provide a heat/pressure "soak." Upon completion of the first time period, the fuel injector 118 is actuated over a second time period. According to various embodiments, the fuel injector 118 may or may not be heated and/or pressurized during the second time period.

At 316, the fuel injector 118 is flushed with calibration fluid. As described above in connection with FIG. 2, the fuel injector 118 is flushed with calibration fluid by controlling the three-way valve 120 to the first position. Flushing the fuel injector 118 with calibration fluid removes any residual cleaning fluid from the fuel injector 118 so as to prevent potential corrosion. In some embodiments, the fuel injector 118 is flushed for a predetermined amount of time.

It should be understood that no claim element herein is to be construed under the provisions of 35 U.S.C. § 112(f), unless the element is expressly recited using the phrase "means for." The schematic flow chart diagrams and method schematic diagrams described above are generally set forth as logical flow chart diagrams. As such, the depicted order and labeled steps are indicative of representative embodiments. Other steps, orderings and methods may be conceived that are equivalent in function, logic, or effect to one or more steps, or portions thereof, of the methods illustrated in the schematic diagrams. Further, reference throughout this specification to "one embodiment," "an embodiment," "an example embodiment," or similar language means that a particular feature, structure, or characteristic described in connection with the embodiment is included in at least one embodiment of the present invention. Thus, appearances of the phrases "in one embodiment," "in an embodiment," "in an example embodiment," and similar language throughout this specification may, but do not necessarily, all refer to the same embodiment.

Additionally, the format and symbols employed are provided to explain the logical steps of the schematic diagrams and are understood not to limit the scope of the methods illustrated by the diagrams. Although various arrow types and line types may be employed in the schematic diagrams, they are understood not to limit the scope of the corresponding methods. Indeed, some arrows or other connectors may be used to indicate only the logical flow of a method. For instance, an arrow may indicate a waiting or monitoring period of unspecified duration between enumerated steps of a depicted method. Additionally, the order in which a particular method occurs may or may not strictly adhere to the order of the corresponding steps shown. It will also be noted that each block of the block diagrams and/or flowchart diagrams, and combinations of blocks in the block diagrams and/or flowchart diagrams, can be implemented by special purpose hardware-based systems that perform the specified functions or acts, or combinations of special purpose hardware and program code.

Many of the functional units described in this specification have been labeled as circuits, in order to more particularly emphasize their implementation independence. For example, a circuit may be implemented as a hardware circuit comprising custom very-large-scale integration (VLSI) circuits or gate arrays, off-the-shelf semiconductors such as logic chips, transistors, or other discrete components. A circuit may also be implemented in programmable hardware devices such as field programmable gate arrays, programmable array logic, programmable logic devices or the like.

As mentioned above, circuits may also be implemented in machine-readable medium for execution by various types of processors, such as the processor 202 of FIG. 2. An identified circuit of executable code may, for instance, comprise one or more physical or logical blocks of computer instructions, which may, for instance, be organized as an object, procedure, or function. Nevertheless, the executables of an identified circuit need not be physically located together, but may comprise disparate instructions stored in different locations which, when joined logically together, comprise the circuit and achieve the stated purpose for the circuit. Indeed, a circuit of computer readable program code may be a single instruction, or many instructions, and may even be distributed over several different code segments, among different programs, and across several memory devices. Similarly, operational data may be identified and illustrated herein within circuits, and may be embodied in any suitable form and organized within any suitable type of data structure. The operational data may be collected as a single data set, or may be distributed over different locations including over different storage devices, and may exist, at least partially, merely as electronic signals on a system or network.

The computer readable medium (also referred to herein as machine-readable media or machine-readable content) may be a tangible computer readable storage medium storing the computer readable program code. The computer readable storage medium may be, for example, but not limited to, an electronic, magnetic, optical, electromagnetic, infrared, holographic, micromechanical, or semiconductor system, apparatus, or device, or any suitable combination of the foregoing. As alluded to above, examples of the computer readable storage medium may include but are not limited to a portable computer diskette, a hard disk, a random access memory (RAM), a read-only memory (ROM), an erasable programmable read-only memory (EPROM or Flash memory), a portable compact disc read-only memory (CD-ROM), a digital versatile disc (DVD), an optical storage device, a magnetic storage device, a holographic storage medium, a micromechanical storage device, or any suitable combination of the foregoing. In the context of this document, a computer readable storage medium may be any tangible medium that can contain, and/or store computer readable program code for use by and/or in connection with an instruction execution system, apparatus, or device.

Computer readable program code for carrying out operations for aspects of the present invention may be written in any combination of one or more programming languages, including an object oriented programming language such as Java, Smalltalk, C++ or the like and conventional procedural programming languages, such as the "C" programming language or similar programming languages.

The program code may also be stored in a computer readable medium that can direct a computer, other programmable data processing apparatus, or other devices to function in a particular manner, such that the instructions stored in the computer readable medium produce an article of manufacture including instructions which implement the function/act specified in the schematic flowchart diagrams and/or schematic block diagrams block or blocks.

Accordingly, the present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes which come within the meaning and range of equivalency of the claims are to be embraced within their scope.

What is claimed is:

1. A fuel injector cleaning fluid, comprising a mixture consisting of approximately 78 percent water, 20 percent ethanol, and 2 percent Sulfamic acid.

2. A fuel injector cleaning fluid, comprising a mixture consisting of water, ethanol, and sulfamic acid, with the mixture comprising water in a range of 78 percent to 82 percent by weight, ethanol in a range of 14 percent to 18 percent by weight, and sulfamic acid in a range of 1 percent to three percent by weight.

3. The fuel injector cleaning fluid of claim 2, wherein the sulfamic acid is 2.05 percent by weight of the mixture.

4. The fuel injector cleaning fluid of claim 2, wherein the water is 81.80 percent by weight of the mixture.

5. The fuel injector cleaning fluid of claim 2, wherein the ethanol is 16.15 percent by weight of the mixture.

6. The fuel injector cleaning fluid of claim 2, wherein the sulfamic acid is 2.05 percent by weight of the mixture, wherein the water is 81.80 percent by weight of the mixture, and wherein the ethanol is 16.15 percent by weight of the mixture.

* * * * *